US006327725B1

(12) United States Patent
Veilleux et al.

(10) Patent No.: US 6,327,725 B1
(45) Date of Patent: Dec. 11, 2001

(54) PILLOW WITH ADJUSTABLE NECK SUPPORT

(75) Inventors: Alain C. Veilleux; Judith J. Stanfield, both of Hull; Charles N. D. Martin, Ottawa, all of (CA)

(73) Assignee: S.V.M. Orthopedic Solutions Inc., Hull (CA)

( * ) Notice: Subject to any disclaimer, the term of this patent is extended or adjusted under 35 U.S.C. 154(b) by 0 days.

(21) Appl. No.: 09/461,074

(22) Filed: Dec. 14, 1999

(51) Int. Cl.[7] ..... A47G 9/02
(52) U.S. Cl. ..... 5/644; 5/645
(58) Field of Search ..... 5/640, 644, 645

(56) References Cited

U.S. PATENT DOCUMENTS

| | | | | |
|---|---|---|---|---|
| 4,501,034 | * | 2/1985 | Greenawalt | 5/644 |
| 4,528,705 | * | 7/1985 | Greenawalt | 5/644 |
| 4,712,259 | | 12/1987 | Chiasson . | |
| 4,805,603 | * | 2/1989 | Cumberland | 5/644 X |
| 4,829,614 | | 5/1989 | Harper . | |
| 4,893,367 | | 1/1990 | Heimreid et al. . | |
| 4,918,774 | * | 4/1990 | Popitz | 5/644 |
| 5,154,649 | | 10/1992 | Pender . | |
| 5,197,461 | | 3/1993 | Petajan et al. . | |
| 5,231,720 | | 8/1993 | Benoff . | |
| 5,471,690 | | 12/1995 | McNeil . | |
| 5,544,378 | | 8/1996 | Chow . | |
| 5,645,319 | | 7/1997 | Parks, Jr. . | |
| 5,771,514 | | 6/1998 | Wilhoit . | |
| 5,797,154 | * | 8/1998 | Contreras | 5/636 |
| 5,802,643 | | 9/1998 | Sloot . | |
| 5,898,963 | | 5/1999 | Larson . | |
| 5,948,013 | | 9/1999 | Swezey et al. . | |

FOREIGN PATENT DOCUMENTS

| | | |
|---|---|---|
| 0 094 985 | 11/1983 | (EP) . |
| 9 276109 | 10/1997 | (JP) . |
| 11 046953 | 2/1999 | (JP) . |
| WO 97/11625 | 4/1997 | (WO) . |
| WO 99/09869 | 3/1999 | (WO) . |

OTHER PUBLICATIONS

JP 9–276109 : Genda: English language abstract.
JP 11–046953 : David : English language abstract.
EP 0 094 985 : Madsen : English language abstract.
OrthoCanada Medical Products brochure.
Tempur–Pedic brochure: date no later than 1997.
Telia GmbH brochure: date no later than Nov., 1999.
Tempur–Canada brochure: date no later than Dec., 1997.

* cited by examiner

*Primary Examiner*—Michael F. Trettel
(74) *Attorney, Agent, or Firm*—Robert A. Wilkes

(57) ABSTRACT

An orthopaedic pillow, including an adjustable neck support. The body of the pillow is comprised of pre-formed visco-elastic foam, which has an interior cavity, longitudinally disposed near the edge of the pillow on which a user's neck is intended to rest. An inflatable airtight chamber is disposed within the cavity or slot, for providing adjustable support to the user's neck. The level of neck support can be quickly and easily adjusted using a hand-operated pump. The pump can be neatly stored within a contoured cavity at one end of the pillow. The pillow has a removable cloth cover with an opening on the end, which enables the user to access the pump, and a closure device for closing the opening. The pillow increases user comfort levels, and assists in reducing neck and back pain.

17 Claims, 1 Drawing Sheet

PILLOW WITH ADJUSTABLE NECK SUPPORT

FIELD OF INVENTION

This invention relates to orthopaedic pillows with adjustable: neck support.

BACKGROUND OF THE INVENTION

The vertebrae of an individual's spine should be in neutral alignment while sleeping, in order to increase the individuals comfort, and reduce neck and back strain. If the neck support in a pillow is too high or too low, the vertebrae in the neck will be out of alignment with the vertebrae in the rest of the spine. This may reduce the restfulness of the individual's sleep, and aggravate neck and back problems. The level of neck support required will vary according to body size and sleeping position. Accordingly, it is desirable to have an adjustable neck support which can be quickly and easily adjusted by the individual, while lying down. It is also desirable for the pillow to distribute the body weight of the individual to decrease compression on compression points. These features will increase comfort levels, and reduce neck and back strain.

The development of visco-elastic foam has introduced a technology that revolutionizes sleeping systems. Visco-elastic foam may be preformed into an orthopaedically designed contour pillow, which provides improved support for a user's head and neck. Visco-elastic foam provides comfort and health benefits because it is heat and pressure sensitive and thereby responds to body weight and temperature by molding to the individual. This provides more evenly distributed support and decreases compression on compression points. However, this technology suffers from at least two limitations. First, because the ideal level of neck support varies depending on the user's body size and sleeping position, a pre-formed visco-elastic pillow will not provide adequate neck support for all users in all sleeping positions. Secondly, because the visco-elastic foam molds to the individual, the support in the neck region may not be sufficiently firm. Accordingly, there is a need for a pre-formed visco-elastic pillow with a neck support which can be custom-adjusted to suit the user's individual needs and sleeping patterns.

There have been numerous attempts to develop adjustable pillows. However, all of the previous products have suffered from one or more shortcomings. Japanese Patent 81.34 116 to M. Genda discloses an L-shaped pillow overlying an air bag. The height of the entire pillow can be raised or lowered by injecting or discharging air from the air bag; however, it is not possible to adjust the level of neck support relative to the rest of the pillow. Accordingly, one cannot custom adjust the level of neck support to ensure that the vertebrae are in neutral alignment. Furthermore, given the large size of the air pillow, it would be relatively difficult to effect rapid changes in the height of the pillow. U.S. Pat. No. 4,829,614 to J. Harper discloses an adjustable pillow with at least three air chambers for adjusting support to the head, neck, and shoulders. However, this device is relatively cumbersome to inflate and deflate to desired levels because the invention lacks a hand-operated air pump or other device which would permit the user to quickly adjust the air levels when changing their sleeping position. Furthermore, the use of multiple air chambers would lead to an uneven and uncomfortable surface beneath the head. Moreover, the adjustable pillows disclosed in the prior art utilizing an air bag do not provide the health benefits and comfort of visco-elastic foam.

SUMMARY OF THE INVENTION

Accordingly, this invention seeks to provide an improved orthopaedic pillow comprised of visco-elastic foam, having an adjustable neck support, which can be quickly and easily adjusted by the user, while lying down.

In its broadest embodiment, this invention provides an adjustable pillow comprising an integral pillow body made of pre-formed visco-elastic foam, having an interior cavity, which is longitudinally disposed near an edge of the pillow, on which user's neck is intended to rest; an inflatable airtight chamber, disposed within the cavity or slot, for providing adjustable support to the user's neck; and a hand-operated pump means, for inflating and deflating the inflatable airtight chamber.

In another embodiment, the invention further comprises a contoured cavity in a side of the pillow body adjacent to the pump means, for receiving and storing the pump apparatus; and a removable cloth cover adapted to fit over the pillow body, including an opening to permit attachment over the pillow body, and a closure device, for closing the opening.

An advantage of this invention is that the level of support for a user's neck can be quickly and easily adjusted by hand operation of the pump apparatus. Accordingly, a user can custom adjust the level of neck support to suit their body size and sleeping position.

A further advantage of this invention is that the pumping means can be neatly stored in a contoured cavity within the pillow body, preferably at one end of the pillow.

BRIEF DESCRIPTION OF THE DRAWINGS

A better understanding of the invention will be obtained by considering the detailed description below, with reference to the following drawings of embodiments of the invention in which.

DETAILED DESCRIPTION OF THE INVENTION

Figure 1:
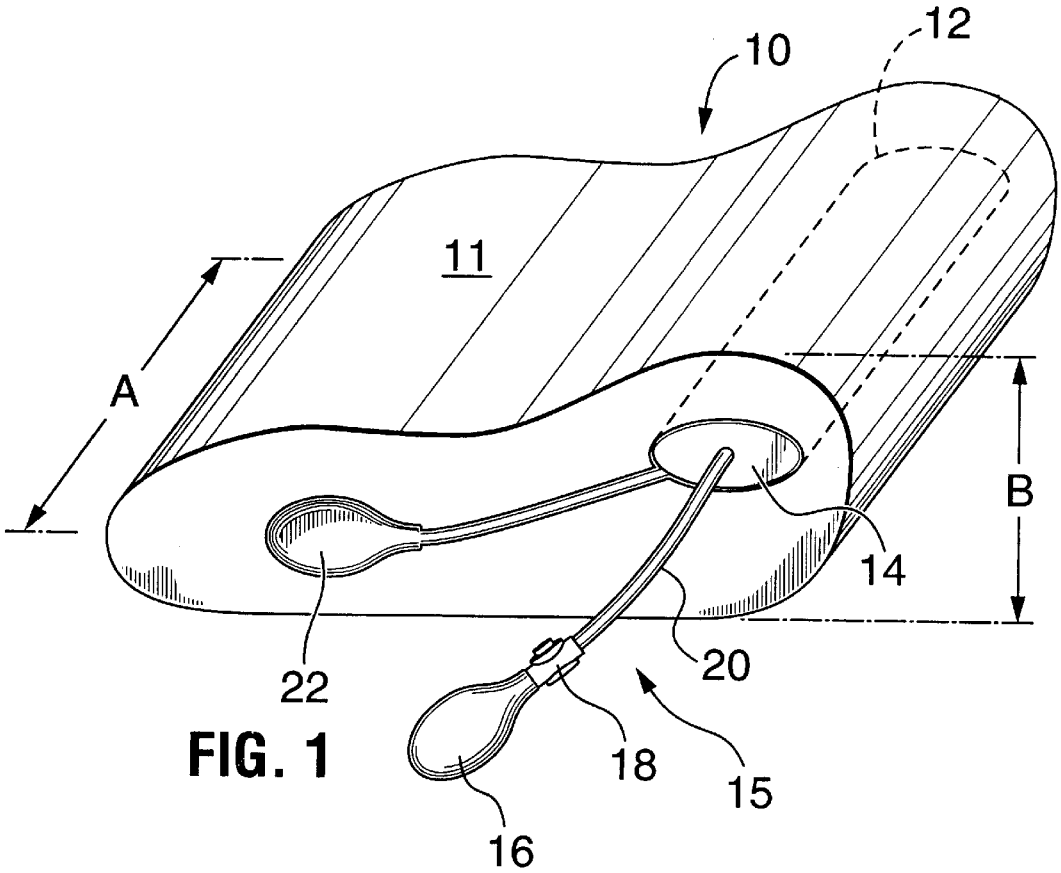
FIG. 1 is a perspective side view showing the adjustable pillow without a pillow covering.

Referring to FIG. 1, the present invention comprises an adjustable pillow, designated generally at 10, which has a pillow body 11 made from pre-formed visco-elastic foam. The pillow-body is orthopaedically contoured and comprises a high density open-celled visco-elastic foam, which is made from Polyol Blend™ and Isocyanate™. The contoured visco-elastic pillow may be manufactured through injection molding, or through other methods of manufacture, which are known in the art.

The pillow body 11 has an internal cavity 12 which is longitudinally disposed along an edge of the pillow body 11, situated approximately where the user's neck is intended to lie. An inflatable air chamber 14 is disposed within the cavity 12 for providing adjustable support to the user's neck. In the embodiment shown, the internal cavity 12 and inflatable air chamber 14 are located approximately 2.5 cms from the top surface of the pillow. We have found this construction to be desirable, in terms of facilitating expansion of the inflatable air chamber 14, and ensuring user comfort due to the thickness of the cushioning layer over the inflatable air chamber 14. However, it will be appreciated by a person skilled in the art that various other designs are possible, and within the scope of this invention. The inflatable air chamber 14 is preferably made of a flexible material such as inflatable grade polyvinyl chloride (PVC), olefin, Hercuflex™, neoprene, latex, or rubber. We have found neoprene to be particularly desirable, because it is relatively soft and flexible, as well as durable. This appears to enhance the comfort level provided by the pillow. The length of the internal cavity 12 and the inflatable air chamber 14 should approximately correspond with the length A of the pillow body 11, while the height B should approximately correspond with the height of a human neck. The inflatable air chamber 14 should be capable of expansion between a range of heights which would provide adequate neck support to a user of the pillow while sleeping in various positions.

The adjustable pillow 10 has a pumping means 15, consisting of a pump 16, a valve 18 and a connecting tube 20. The connecting tube 20 connects the pump 16 and valve 18 to the inflatable air chamber 14 and permits the flow of air therebetween. The connecting tube 20 is preferably made of a flexible and durable plastic. The valve 18 regulates the inflation and deflation of the inflatable air chamber 14. In the embodiment shown, the valve 18 is a one-button valve, which is easily operated by depressing or releasing the button on the valve. The pump 16 is a hand-operated air pump, which is made of a flexible material, such as polyvinyl chloride (PVC). The pump 16 and valve 18 permit a user to quickly and easily inflate or deflate the inflatable air chamber 14 to adjust the level of neck support. Pump means of this type are well known; other sources of compressed air are available, and could be used, such as a pressurised reservoir together with a control valve.

The side of the pillow body 11 adjacent the pump 16 contains a contoured cavity 22 adapted to receive the pumping apparatus 15. Thus the pumping apparatus 15 may be neatly stored within the pillow body 11 when not in use. The contoured cavity 22 should be located a sufficient distance below the top surface of the pillow body 11 that the user cannot feel the stored pumping apparatus 15 when resting their head on the pillow body 11.

Figure 2:
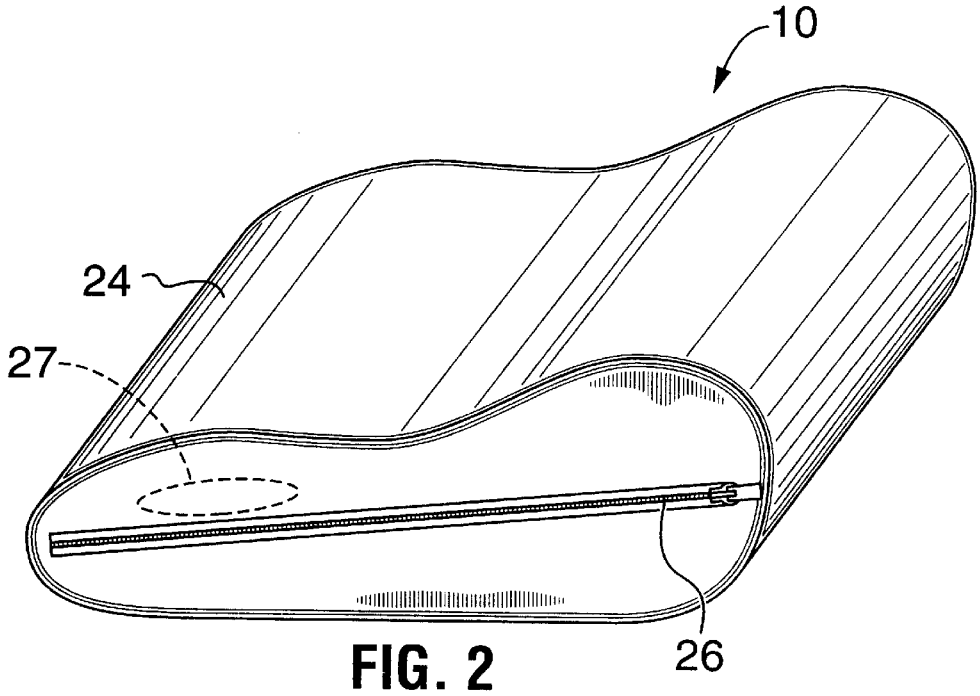
FIG. 2 is a perspective side view showing the adjustable pillow with a pillow covering.

Referring to FIG. 2, the pillow body 11 has a removable cover 24. Preferably the removable cover 24 comprises a soft material, such as Sherpa or terry cloth, which will maximize user comfort. The cover 24 has an opening at the side of the pillow adjacent the pump apparatus 15, to allow the user to access the pump 16 and valve 18. Preferably the cover 24 has a closure device 26 such as a zipper or cooperating hook and loop fabric strips. Thus the user may conceal the pumping apparatus 15 by storing the pumping apparatus 15 within the contoured cavity 22, and closing the closure device 26 of the cover 24.

In use, the user may adjust the level of neck support in the adjustable pillow 10 by inflating or deflating the air chamber 14 with the pump 16 or the valve 20. In this way, the user can quickly and easily adjust the level of neck support in accordance with their body size and sleeping position, while lying down. Proper use of the adjustable pillow will ensure that the vertebrae of the user's spine are in neutral alignment, which maximizes user comfort and reduces neck strain and back problems.

In the pillow as shown in FIGS. 1 and 2, the pump 16 and the valve 20 are at the same end of the cover 24 as the closure device 26. It is also possible to locate the pump 16 and the valve 20 at the other end of the pillow, remote from the closure device 26. The pump 16 and valve 20 can be readily operated through the fabric. Alternatively, a small access aperture, for example as shown ghosted at 27, can be provided either end of the cover 24 adjacent the pump 16 and valve 20. If desired, such an aperture can be provided with a closure device.

The embodiments of the invention in which an exclusive property or privilege is claimed are defined as follows:

1. An adjustable pillow, comprising:

an integral pillow body comprised of pre-formed visco-elastic foam, having an interior cavity or slot, which is longitudinally disposed near an edge of the pillow, where a user's neck would rest;

an inflatable airtight chamber, disposed within the cavity or slot, for providing adjustable support to the user's neck;

a hand-operated pump apparatus, for inflating and deflating the inflatable airtight chamber, wherein a side of the pillow body adjacent to the pump apparatus has a contoured cavity adapted to receive and store the pump apparatus.

2. An adjustable pillow according to claim 1, wherein the visco-elastic foam is orthopaedically contoured by injection molding of the foam.

3. An adjustable pillow according to claim 1, wherein the length of the interior cavity or slot and the inflatable airtight chamber is substantially equal to the length of the pillow, and the width of the interior cavity or slot and the adjustable airtight chamber is substantially equal to the height of a person's neck.

4. An adjustable pillow according to claim 1, wherein the inflatable airtight chamber comprises a material selected from the group consisting of inflatable grade polyvinyl chloride, olefin, neoprene, latex, a rubber.

5. An adjustable pillow according to claim 4, wherein the inflatable airtight chamber consists of neoprene.

6. An adjustable pillow according to claim 1, wherein the inflatable airtight chamber is capable of expansion between a range of heights which provide adequate neck support to the user while sleeping in various positions.

7. An adjustable pillow according to claim 1, wherein the hand-operated pump apparatus comprises:

an air pump for inflating the inflatable airtight chamber;

a valve means, for regulating the inflation and deflation of the inflatable airtight chamber; and a connecting means having a continuous internal passageway, for connecting the air pump and valve means to the inflatable airtight chamber and for transmitting airflow therebetween.

8. An adjustable pillow according to claim 7, wherein the air pump is comprised of a flexible material.

9. An adjustable pillow according to claim 8, wherein the flexible material consists of polyvinyl chloride.

10. An adjustable pillow according to claim 7, wherein the connecting means comprises flexible tubing.

11. An adjustable pillow according to claim 7, wherein the valve means consists of a one-button valve.

12. An adjustable pillow according to claim 1, further comprising a removable cloth cover, adapted to fit over the pillow body, having an opening adjacent the pump apparatus to permit access to the pump apparatus, and having a closure device for closing the opening.

13. An apparatus according to claim 12, wherein the closure device is a zipper.

14. An adjustable pillow, comprising:

an integral pillow body comprised of pre-formed visco-elastic foam, having an interior cavity or slot, which is longitudinally disposed near an edge of the pillow, where a user's head would rest;

an inflatable airtight chamber, disposed within the cavity or slot, for providing adjustable support to the user's neck;

a hand-operated pump apparatus for inflating and deflating the inflatable airtight chamber;

a contoured cavity in a side of the pillow body adjacent to the pump apparatus, for receiving and storing the pump apparatus; and a removable cloth cover adapted to fit over the pillow body, having an opening to permit attachment over the pillow body, and having a closure device, for closing the opening.

15. An adjustable pillow according to claim 14 wherein the opening and closure device are located adjacent one end of the pillow.

16. An adjustable pillow according to claim 14 further including an access aperture adjacent the pump means.

17. An adjustable pillow according to claim 14 further including a closure means for the access aperture.

* * * * *